US012729041B2

(12) United States Patent
Tuttle

(10) Patent No.: US 12,729,041 B2
(45) Date of Patent: Sep. 8, 2026

(54) FOOD DELIVERY BAG OPENING SUPPORT SYSTEM

(71) Applicant: Randall Paul Tuttle, Hazel Green, AL (US)

(72) Inventor: Randall Paul Tuttle, Hazel Green, AL (US)

(73) Assignee: Randall P. Tuttle, Hazel Green, AL (US)

( * ) Notice: Subject to any disclaimer, the term of this patent is extended or adjusted under 35 U.S.C. 154(b) by 115 days.

(21) Appl. No.: 18/961,789

(22) Filed: Nov. 27, 2024

(65) Prior Publication Data

US 2026/0145845 A1 May 28, 2026

(51) Int. Cl.
*B65D 33/00* (2006.01)
*B65D 33/24* (2006.01)

(52) U.S. Cl.
CPC ..... *B65D 33/007* (2013.01); *B65D 33/24* (2013.01)

(58) Field of Classification Search
CPC ..... B65D 33/007; B65D 33/24
USPC ..... 383/33
See application file for complete search history.

(56) References Cited

U.S. PATENT DOCUMENTS

| | | | | |
|---|---|---|---|---|
| 6,658,801 | B2 * | 12/2003 | Kilduff | A62C 2/10 160/354 |
| 7,232,018 | B1 * | 6/2007 | Salander | A45C 5/14 280/37 |
| 2007/0068563 | A1 * | 3/2007 | Weng | A45B 25/24 135/33.4 |
| 2007/0157653 | A1 * | 7/2007 | Sasaki | B65D 81/3818 62/457.7 |
| 2020/0215375 | A1 * | 7/2020 | Fujii | A63B 21/072 |

* cited by examiner

*Primary Examiner* — Peter N Helvey

(57) ABSTRACT

A food delivery bag opening support system, includes an elongated support member having a first and second end and two secondary support members of the same composition, one at each end of the primary member. The support members are incased in a thin, pliable material and secured with sewn stitching at both ends and between the primary and secondary members. The support members are then placed between two layers of hook and loop type fastener strips and secured with sewn stitching on all edges. The support members have a stiff yet flexible property that will allow the support member to be flexed out of the resting state and then return back to the resting state. The assembled support system can be affixed inside a food delivery bag having existing hook and loop type fasteners or using adhesive attached hook and loop type strip fasteners.

9 Claims, 4 Drawing Sheets

FOOD DELIVERY BAG OPENING SUPPORT SYSTEM

CROSS-REFERENCE TO RELATED APPLICATIONS

The present application claims priority to U.S. provisional patent application Ser. No. 63/731,903, filed on Jun. 21, 2024. The entire disclosure is included herein in its entirety at least by reference.

BACKGROUND OF THE INVENTION

1. Field of the Invention

The present invention is in the field of food delivery bags and pertains particularly to pizza delivery bags.

2. Discussion of the Related Art

The purpose of this invention is to allow the removal of food boxes from delivery bags without the opening roof and sides of the delivery bag collapsing and catching on the food boxes inside the delivery bag. This invention will allow the quick and easy removal of the food boxes without risk of damaging the food boxes or their contents.

Food delivery bags have been in existence for years but there has not been any form of support incorporated into the delivery bags to hold the opening open, thus causing the contents of the delivery bag to catch on the roof and sides of the delivery bag making it difficult to remove the contents.

In this respect, the food delivery bag opening support system according to the present invention substantially departs from the conventional designs of the prior art, and provides an apparatus mainly created for the purpose of eliminating the difficulties of removing the contents of the delivery bag. This invention will dramatically impact the food delivery process by allowing the quick and efficient removal of contents from the food delivery bag and therefor reducing the risk of damage to the delivery bag contents.

BRIEF SUMMARY OF THE INVENTION

In respect of the current disadvantages inherent in the current designs of food delivery bags, the present invention augments the current design of food delivery bags to reduce or eliminate the occurrence of difficulty in removing food boxes from the food delivery bags.

The purpose of the present invention, described in greater detail, is to provide a novel support system for food delivery bags including novel features that were not anticipated, rendered obvious, suggested, or even implied by any prior art food delivery bag opening support systems.

The present invention generally comprised of an elongated primary support member and secondary support members at both ends of the primary support member. The support members are encased in a thin and pliable casing and secured with sewn closures at the first end and the second end as well as between the primary support member and the two secondary support members and then entirely encased between a top layer and a bottom layer of hook and loop type fastener strips being secured with sewn stitching on all edges.

As broadly outlined above, vital details of this invention to be better understood and appreciated will be described hereinafter and will form subject matter to support the claims appended hereto.

In this respect, before revealing at least one embodiment of invention, it is implied and understood that the invention is not limited in the application to the details of construction and placement of the components as described in the following description or illustrated in the drawings. It is also to be understood that the terminology contained herein are for the purpose of the description and should not be regarded as limiting.

A primary objective of the present invention is to provide a food delivery bag opening support system that will overcome current issues in prior art delivery bags.

A secondary objective is to provide a food delivery bag opening support system that will alleviate difficulties in removing contents from delivery bags.

Another objective is to allow the contents to be removed more quickly from delivery bags.

An additional objective is to better ensure that the contents of food delivery bag is not damaged in the removal process from delivery bag.

Additional objectives of the present invention will become apparent to the reader and intended that these objectives are well within the scope of the present invention.

BRIEF DESCRIPTION OF THE SEVERAL VIEWS OF THE DRAWINGS

Additional features, advantages and objectives will become fully appreciated and better understood when considered in conjunction with the accompanying drawings.

Reference characters will designate specific parts and aspects of the invention with several views and wherein.

DETAILED DESCRIPTION OF THE INVENTION

Figure 1:
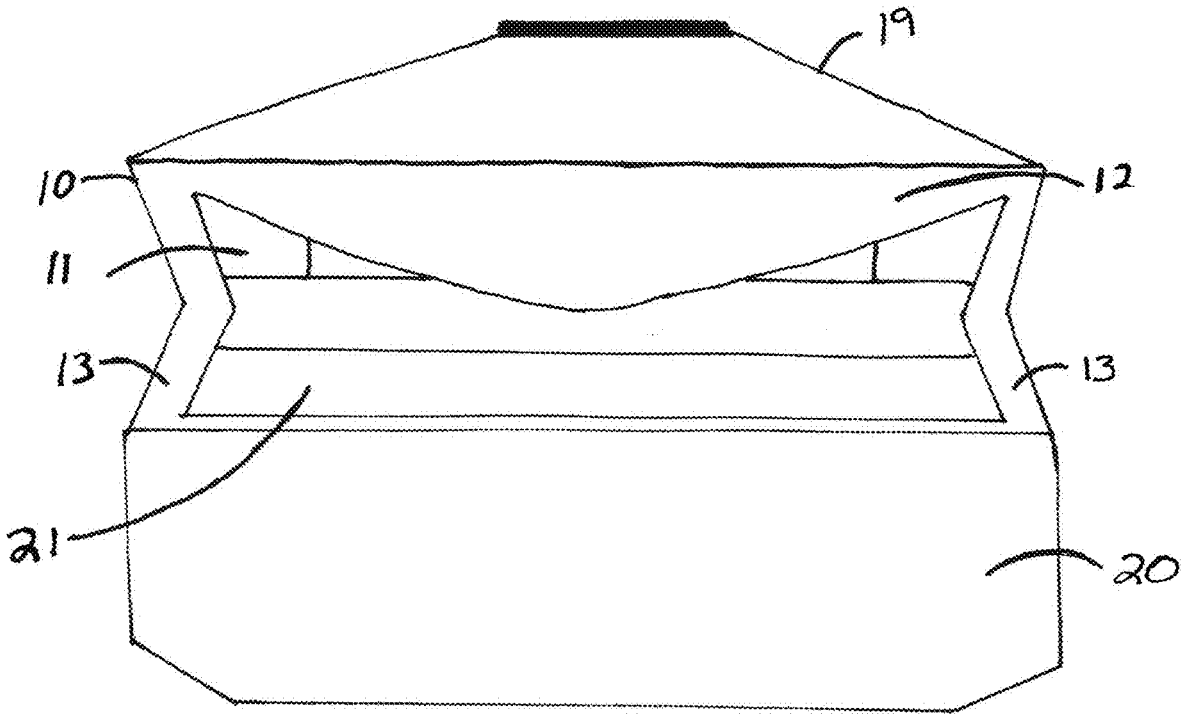
FIG. 1 is an illustration showing the delivery bag with the opening displayed prior to installing the invention. Noting the unsupported roof and sides encumbering the contents.
Figure 2:
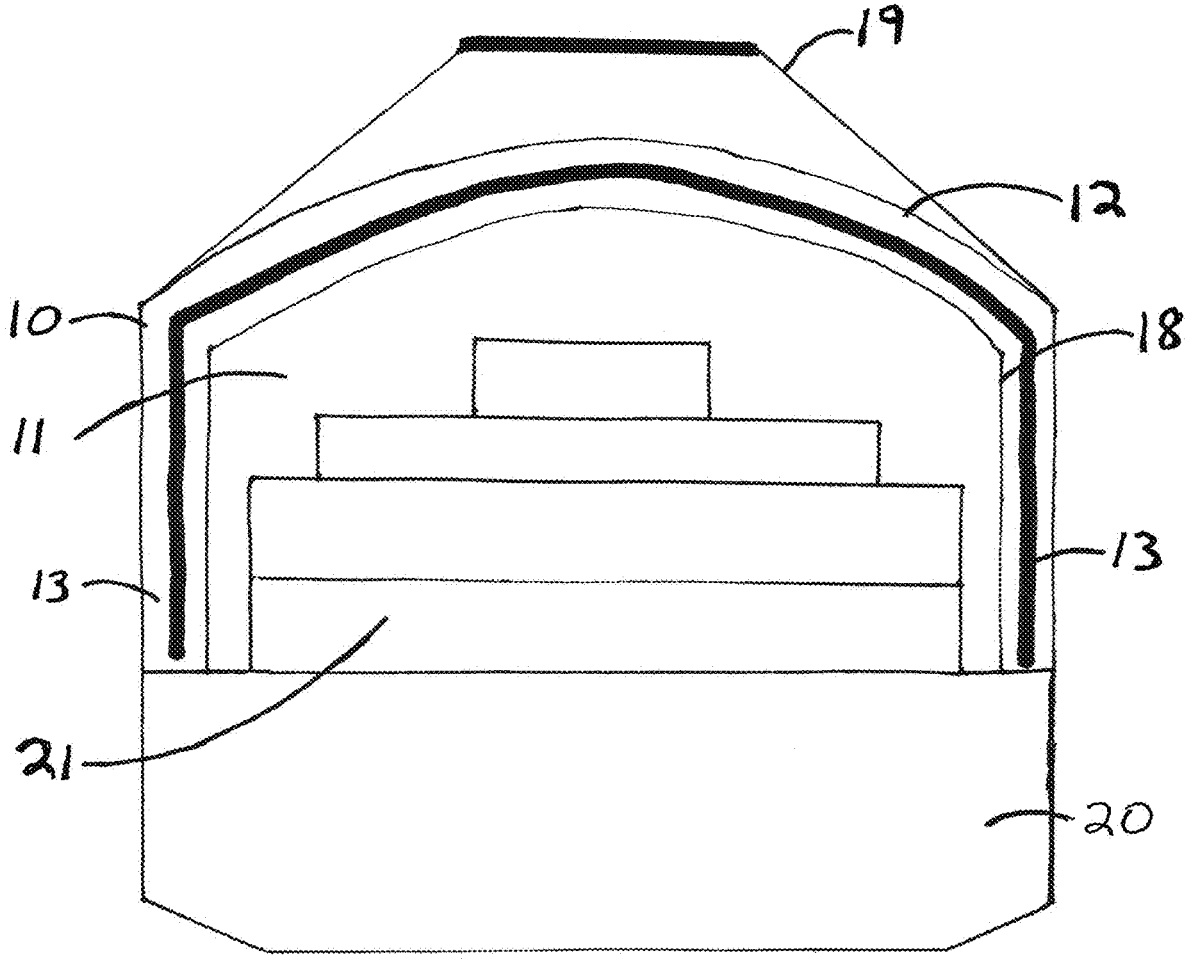
FIG. 2 is an illustration showing the delivery bag with the opening displayed after installing and engaging the invention. Showing the additional space created by the invention where the contents are no longer encumbered.

The inventor provides a novel support system to be used inside food delivery bags to allow the bag opening to be supported when removing the bag contents. The present invention is described in detail in the following examples, which may represent more than one embodiment of the present invention.

In the provided illustrations, FIGS. 1 through 4, according to an embodiment of the present invention, you will see how the food delivery bag 10 with the bag opening 11 and bag sides 13 in the collapsed state as well as in the open state. This invention with a primary support member 14, and secondary support members 15 are incased in a thin and pliable casing 16 and then placed securely between two layers of hook and loop fastener strips 17, one hook type fastener layer on one side and one loop type fastener layer on the opposite side by sewn stitching 22 and will be fixed inside the delivery bag opening 11 between the delivery bag 10 roof 12 and sides 13 and the bag liner 18 using the existing hook and loop type fasteners that hold the liner 18 in place. If the delivery bag 10 does not have an existing hook and loop type fastener nor a liner 18, an adhesive hook and loop type fastener strip may be used to fasten the primary support member 14 and the secondary support members 15 in place.

Figure 3:
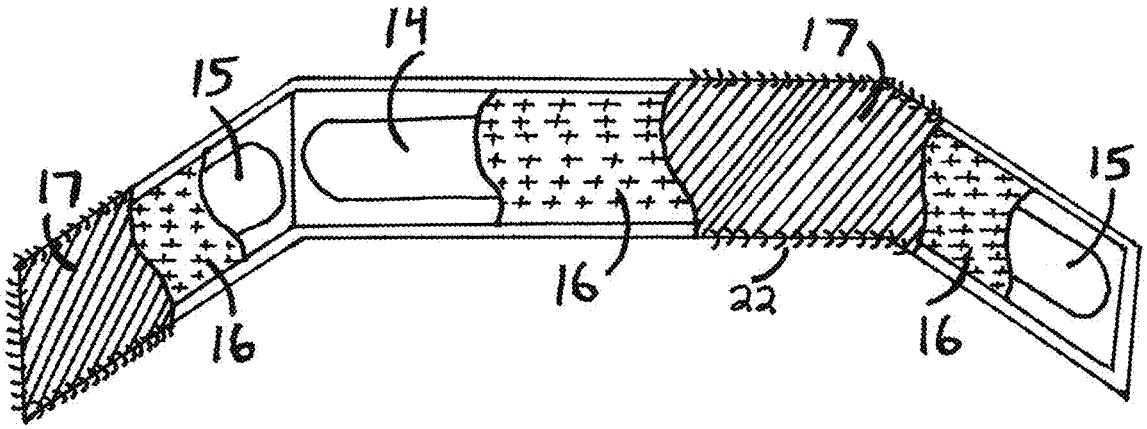
FIG. 3 is showing the invention components and how they are assembled.
Figure 4:
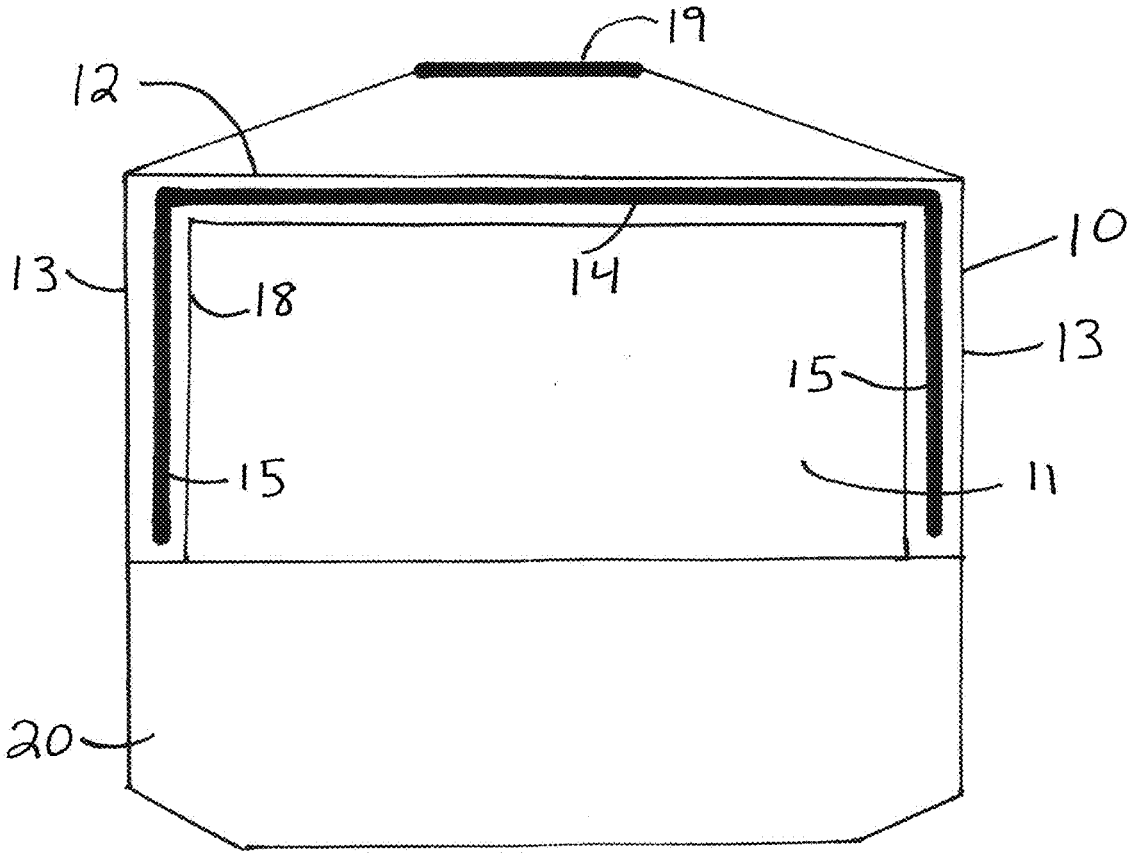
FIG. 4. Is a front view of a delivery bag with existing hook and loop fasteners and how the invention is installed.

Best depicted in FIG. 3 of the drawings according to an embodiment of the present invention, a primary support member 14 and secondary support members 15 consisting of an elongated member preferably flat in structure with rounded ends. The stated elongated primary support member 14 and secondary support members 15, preferably comprised of a metal such as steel and may be coated with paint or other form of coating. The elongated primary member 14 and secondary support members 15 have a stiff yet flexible property that will allow the primary support member 14 and secondary support members 15 to be flexed out of the resting state and then return back to the resting state. However, it can be appreciated that the primary support member 14 and secondary support members 15 may be comprised of any common material such as metal, plastic, or carbon fiber. Primary support members 14 and secondary support members 15 are then encased inside a casing 16 comprised of a thin and pliable material such as fabric and secured with a sewn stitching 22 at the first end and at the second end as well as between the primary support member 14 and the two adjacent secondary support members 15. The cased and secured primary support member 14 and secondary support members 15 will then be placed between a top layer and a bottom layer of hook and loop type fastener strips 17 and secured with sewn stitching 22 on all edges. The completed support system will be allowed to bend at the point between the primary support member 14 and secondary support members 15.

When in use, according to an embodiment of the present invention, the user will support the food delivery bag 10 by the top handle 19 and grasp the bag opening flap 20 and release the flap 20 to expose the bag opening 11. The user would then engage the invention by lifting up on the primary support member 14 centered between the first end and the second end until the invention is fully engaged. The contents 21 of the delivery bag are then extracted from the delivery bag 10, noting that the sides 13 and roof 12 of the delivery bag are being supported and not hindering the user from removing the contents 21. After the contents 21 of the delivery bag 10 have been removed, the user would then disengage the invention by pressing down on the primary support member 14 centered between the first end and the second end thus returning the invention to its resting state.

With respect to the above description, it is to be realized that the preferred dimensional relationships for the parts of the invention, including variations in size, shape, materials, form, function and manner of operation, assembly and use, are deemed readily apparent and obvious to one skilled in the art, and all relationships to those depicted in the drawings and specifications are intended to be encompassed by the present invention.

As stated, the foregoing is considered as illustrative only of the principles of the invention. Further, since numerous changes and modification will readily occur to those skilled in the art, it is not desired to limit the invention to the exact construction and operation shown and described. All suitable changes may be resorted to, falling within the scope of the invention.

I claim:

1. A food delivery bag opening support system, comprising:

an elongated primary member having a first end and a second end and a secondary member of the same composition one each at both ends of the primary member, wherein the members are flat and solid in structure and wherein the first end and second end of the members are rounded and coated.

2. The food delivery bag opening support system of claim 1, wherein the support members are incased in a thin and pliable material.

3. The food delivery bag opening support system of claim 2, wherein the thin and pliable material is secured with sewn stitching at the first end, second end and between the ends of the primary member and the secondary members.

4. The food delivery bag opening support system of claim 3, wherein the incased members are placed between two layers of hook and loop fastener strips.

5. A food delivery bag opening support system of claim 4, wherein the hook and loop type fastener strips are secured with sewn stitching along all edges.

6. A food delivery bag opening support system, comprising:

an elongated primary member having a first end and a second end and a secondary member of the same composition one each at both ends of the primary member; and wherein the members are encased in a thin and pliable material; and placed between two layers of hook and loop type fasteners strips being secured with sewn stitching.

7. The food delivery bag opening support system of claim 6, wherein the support members have a stiff yet flexible property that will allow the support member to be flexed out of the resting state and then return back to the resting state.

8. The food delivery bag opening support system of claim 6, wherein the assembled support system can be affixed inside a food delivery bag having existing hook and loop type fasteners.

9. The food delivery bag opening support system of claim 6, wherein the assembled support system can be affixed inside a food delivery bag not having existing hook and loop type fasteners using an adhesive attached hook and loop type fasteners strips.

* * * * *